US005510591A

United States Patent [19]

Tremblay et al.

[11] Patent Number: 5,510,591

[45] Date of Patent: Apr. 23, 1996

[54] HIGH TENSION CIRCUIT BREAKER CAPABLE OF INTERRUPTING FAULT CURRENTS HAVING A DELAYED ZERO CROSSING

[75] Inventors: Jocelyn Tremblay, Delson, Canada; René Doche, Villeurbanne, France; André LeFrancois, Greenfield Park, Canada

[73] Assignee: GEC Alsthom T & D SA, Paris, France

[21] Appl. No.: 320,743

[22] Filed: Oct. 11, 1994

[30] Foreign Application Priority Data

Oct. 12, 1993 [FR] France ..... 93 12118

[51] Int. Cl.[6] ..... H01H 33/70; H01H 33/88

[52] U.S. Cl. ..... 218/43; 218/44; 218/58; 218/59; 218/84

[58] Field of Search ..... 200/144 R, 144 A, 200/144 C, 144 B, 148 R, 148 A, 148 B, 148 F, 148 BV, 82 B; 218/1, 3, 6, 7, 43–45, 51, 57–60, 63, 66, 71, 78, 84, 87, 121, 140, 89, 149–151, 156

[56] References Cited

U.S. PATENT DOCUMENTS

| | | | |
|---|---|---|---|
| 3,659,065 | 4/1972 | Roidt et al. | 200/148 R |
| 4,159,498 | 6/1979 | Noeske | 200/148 R |
| 4,228,333 | 10/1980 | Kii | 200/148 R |
| 5,066,839 | 11/1991 | Maineult et al. | 200/144 R |
| 5,373,131 | 12/1994 | Perret et al. | 200/148 A |

FOREIGN PATENT DOCUMENTS

| | | | |
|---|---|---|---|
| 2398378 | 2/1979 | France | H01H 33/42 |
| 2678770 | 1/1993 | France | H01H 33/56 |
| 2681724 | 3/1993 | France | H01H 33/74 |
| 2683937 | 5/1993 | France | H01H 33/59 |
| 2684486 | 6/1993 | France | H01H 33/16 |
| 599314 | 6/1934 | Germany | H01H 3/52 |
| 555589 | 9/1974 | Germany | H01H 33/02 |

*Primary Examiner*—J. R. Scott

*Attorney, Agent, or Firm*—Sughrue, Mion, Zinn, Macpeak & Seas

[57] ABSTRACT

The invention relates to a high tension circuit breaker capable of interrupting alternating fault currents which have a pseudo period T. The faults occur at an instant $t_0$ and delay the zero crossing of the current after a maximum time lapse of $t_{zmax}-t_0$. The circuit breaker includes a plurality of interrupting chambers in series. These chambers open at an instant $t_1$ which is subsequent to the fault instant $t_0$ and include moving equipment and an arc blaster. The arc blaster operates between instant $t_1$ and instant $t_c$, where instant $t_c$ is earlier than the instant $t_{zmax}-T$. The circuit breaker also includes a feature which causes blasting to be extended to an instant $t_2$ lying in the range $t_{zmax}-T$ and $t_{zmax}+T$.

7 Claims, 4 Drawing Sheets

HIGH TENSION CIRCUIT BREAKER CAPABLE OF INTERRUPTING FAULT CURRENTS HAVING A DELAYED ZERO CROSSING

FIELD OF THE INVENTION

The present invention relates to a high tension circuit breaker capable of interrupting fault currents having a delayed zero crossing.

More precisely, it relates to a high tension circuit breaker capable of interrupting alternating fault currents of pseudo-period T and having a delayed zero crossing. The currents pass through zero after a maximum time lapse $t_{zmax}-t_0$ after the instant $t_0$ on which the fault appears. The time lapse $t_{zmax}-t_0$ is determined by simulation or by testing. The circuit breaker comprises a plurality of interrupting chambers in series fitted with means for causing them to open at an instant $t_1$ subsequent to the fault instant $t_0$. The interrupting chambers include arc blasting means designed to operate between the instant $t_1$ and an instant $t_c$ earlier than the instant $t_{zmax}-T$.

BACKGROUND OF THE INVENTION

There are major problems in interrupting currents having a large DC component or a delayed zero crossing, as can happen on the appearance of certain types of faults, e.g. in high tension AC networks with series compensation. The presence of the DC component can prevent the current from passing through zero for several pseudo-periods. That makes it impossible to interrupt the current using conventional sulfur hexafluoride circuit breakers.

To remedy such problems, it is well known to increase arc tension by suitable means. High arc tension makes it possible to absorb the energy of the DC component and cause it to tend to zero.

For this purpose, French patent document No. 2 681 724 proposes using an interrupting chamber provided with means for creating a plurality of arcs in series.

Proposals have also been made in French patent document No. 2 678 770 to use an interrupting chamber having permanent fuses in series with a conventional high tension interrupting chamber. The melting of the fuses when tripping on a fault produces a very high arc tension which causes the DC component of the fault current to decrease very rapidly.

It is also known that the energy of the network due to the DC component can be absorbed by temporarily inserting a resistance in the circuit. A suitable resistance makes it possible to cause the DC component to tend towards zero in a relatively short time. One such disposition is described in French patent document No. 2 683 937.

It is also known that having a large-capacitance capacitor in series with an inductor disposed in parallel with an interrupting chamber of a circuit breaker gives rise to current oscillations when the circuit breaker is opened that increase the arc tension and give rise to arc instability that favors a decrease in the DC component and contributes to causing the current to pass through zero. That is the case described in French patent document No. 2 684 486.

Those solutions require novel devices to be used. The aim of the present invention is to solve the problem of interrupting fault currents having a delayed zero crossing while using conventional interrupting chambers only. The circuit breaker of the present invention requires no more than a particularly simple modification to the control apparatus.

OBJECT AND SUMMARY OF THE INVENTION

According to the invention, the circuit breaker includes blast flow rate reducing means adapted to cause blasting to be extended to an instant $t_2$ lying in the range $t_{zmax}-T$ and $t_{zmax}+T$, where T is the pseudo-period of the fault current.

This disposition has the advantage of requiring no intelligent fault current detection apparatus and of being totally automatic.

Preferably, the instant $t_2$ is substantially equal to $t_{zmax}$.

On practical considerations, the time $t_2-t_0$ is substantially equal to seven pseudo-periods.

When the arc blasting means are constituted by a piston cooperating by displacement relative to moving equipment carrying a moving arcing contact and subjected to normal opening displacement at a normal opening speed defined by normal operating conditions, the blast flow rate reducing means are slowing-down means for slowing down the moving equipment beyond a threshold displacement d.

Preferably, the threshold displacement d is a fraction of the normal stroke, lying in the range 2D/3 and D, where D is the total normal stroke of the moving equipment.

Advantageously, when slowed down, the moving equipment moves at constant speed.

For a circuit breaker including a hydraulic actuator driving the moving equipment and including a piston connected to a damping cone co-operating with a ring, the slowing-down means are advantageously constituted by a length of cylinder extending between the piston and the cone, the ring being adjusted to obtain a certain amount of radial clearance between itself and the length of cylinder.

BRIEF DESCRIPTION OF THE DRAWINGS

The invention is described in greater detail below with reference to the accompanying drawings that show a preferred embodiment of the invention.

DETAILED DESCRIPTION

Figure 1:
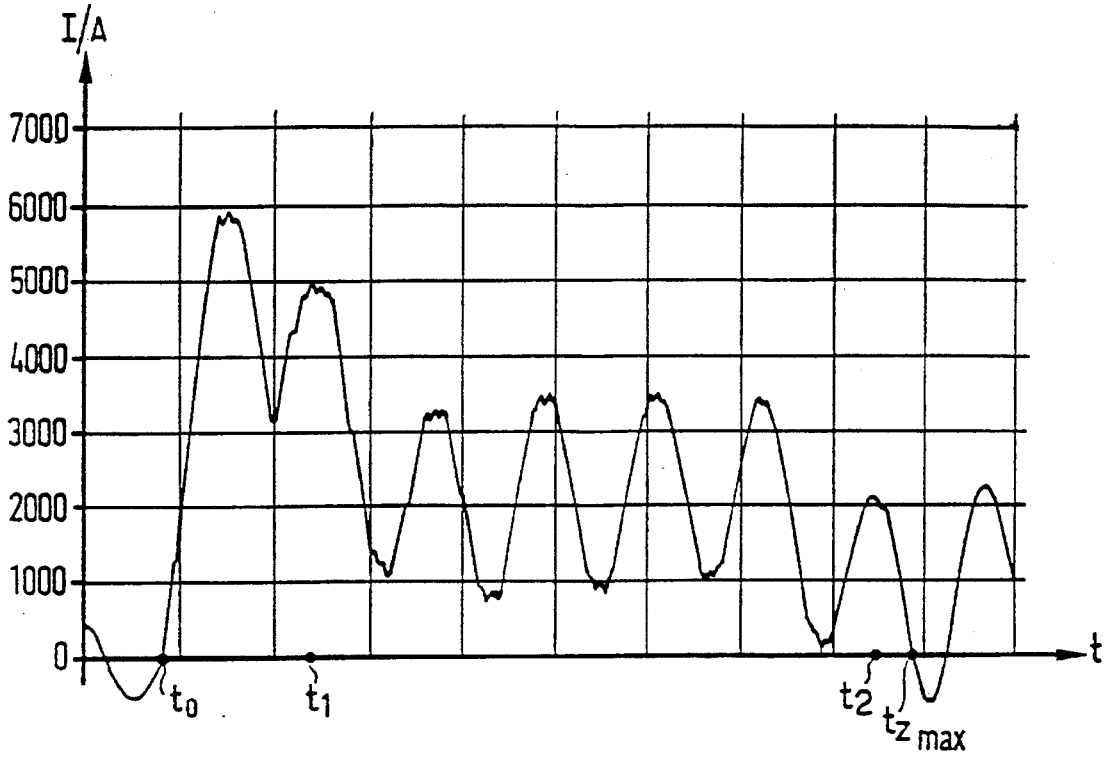
FIG. 1 is a graph showing variations in an alternating current having a delayed zero crossing.

The oscillogram of FIG. 1 shows a fault current with a delayed zero crossing. Time is plotted along the abscissa and current is plotted up the ordinate. The current axis is graduated in thousands of amps, while the time axis is graduated in arbitrary time units.

The term "pseudo-period" is used herein to designate the "period" of a waveform that departs significantly from being truly periodic. Common values of pseudo-periods on power supply networks are 1/50th and 1/60th of a second.

The fault current appears at instant $t_0$ and contributes to delaying the following zero crossing for some time. Such behavior is determined by testing and/or simulation, and for a given network and for expected fault currents it is therefore possible to determine the maximum lapse of time before the zero crossing and thus the instant $t_{zmax}$ of said zero crossing.

On the appearance of the fault current at instant $t_0$, the order to open the circuit breaker is given and the circuit breaker opens at instant $t_1$.

Figure 2:
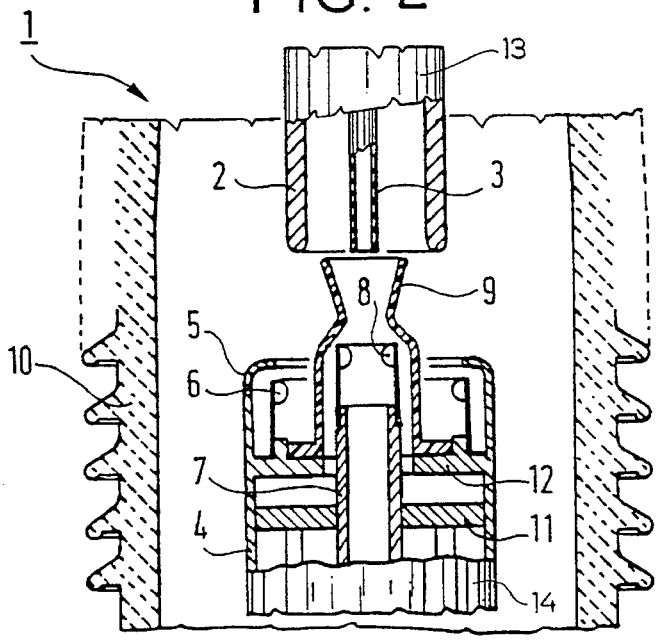
FIG. 2 is a fragmentary longitudinal section view through a conventional circuit breaker.

An interrupting chamber 1 of a circuit breaker in accordance with the invention and capable of interrupting such fault currents is shown in FIG. 2. It is a conventional puffer chamber including, within an insulating enclosure 10, current-interrupting elements comprising a first metal tube 2 constituting a stationary main contact and a second tube 3 which is coaxial with the first and forms a stationary arcing contact. These two contacts are connected to a first current terminal 13. The enclosure is filled with a gas having good dielectric properties, e.g. sulfur hexafluoride, and at a pressure of a few bars.

The moving equipment comprises a metal tube 4 extended by an anti-corona cap 5 and provided with a transverse metal partition 12 carrying contact fingers 6 constituting the moving main contact, and a blast tube 7 extended by contact fingers 8 constituting the moving arcing contact. The partition 12 is pierced by holes for the passage of the blast gas and it carries a blast nozzle 9 made of insulating material. The blast is driven by a stationary piston 11 disposed inside the tube 4. The tube 4 is connected to a second current terminal 14.

The circuit breaker includes a plurality of such interrupting chambers per phase.

Figure 3:
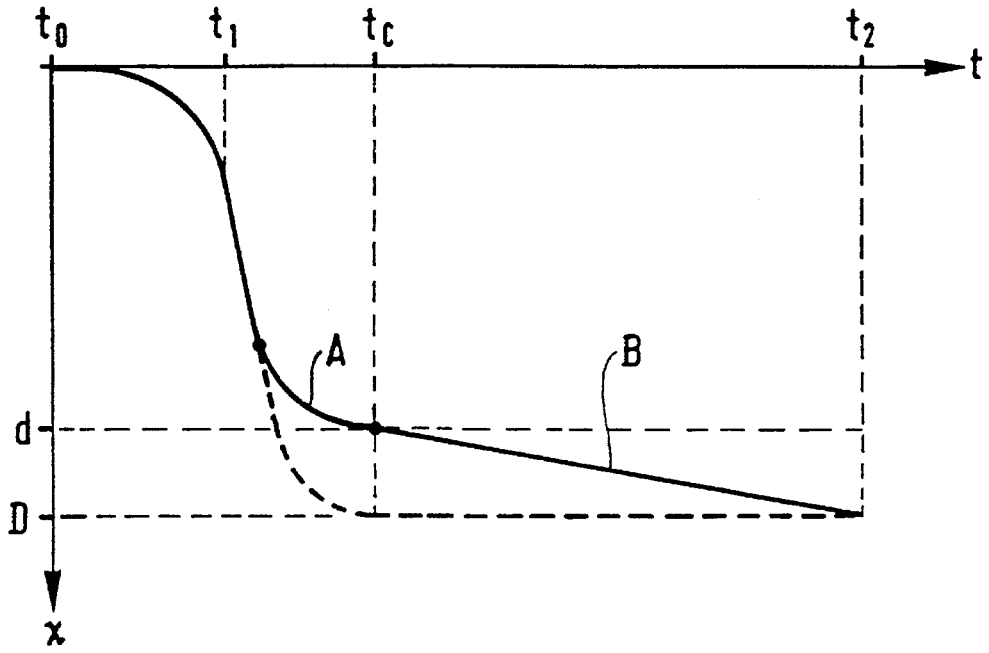
FIG. 3 is a graph showing the displacement of the moving arcing contact of a first variant circuit breaker of the invention as a function of time.
Figure 4:
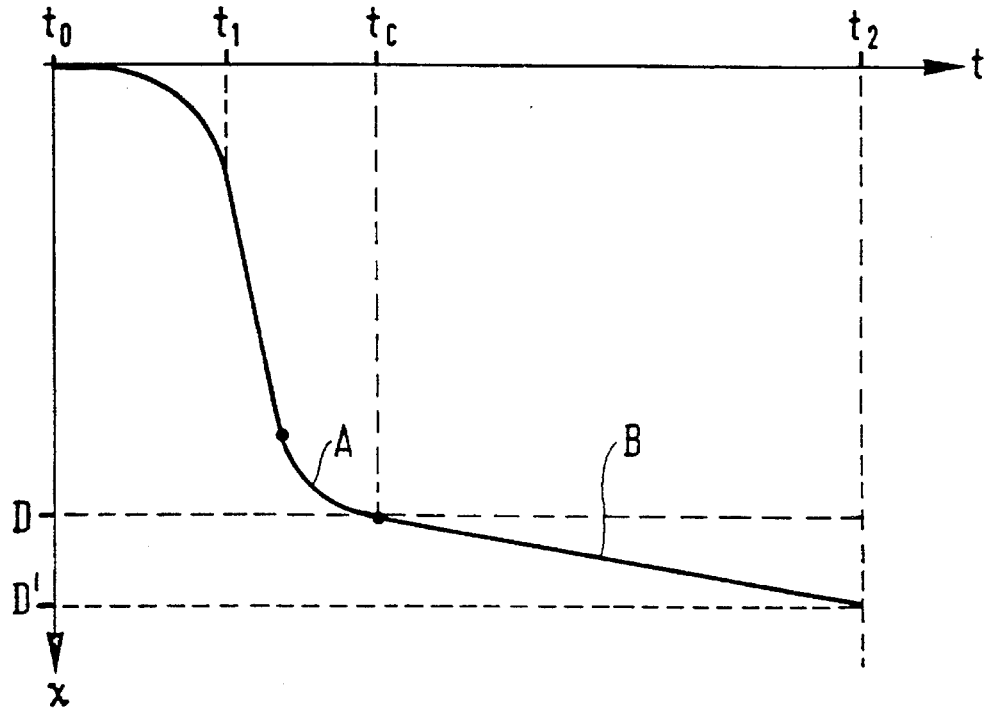
FIG. 4 is a graph showing the displacement of the moving arcing contact of a second variant circuit breaker of the invention as a function of time.

The displacement of the moving equipment is defined by the graphs given in FIGS. 3 and 4.

Figure 6:
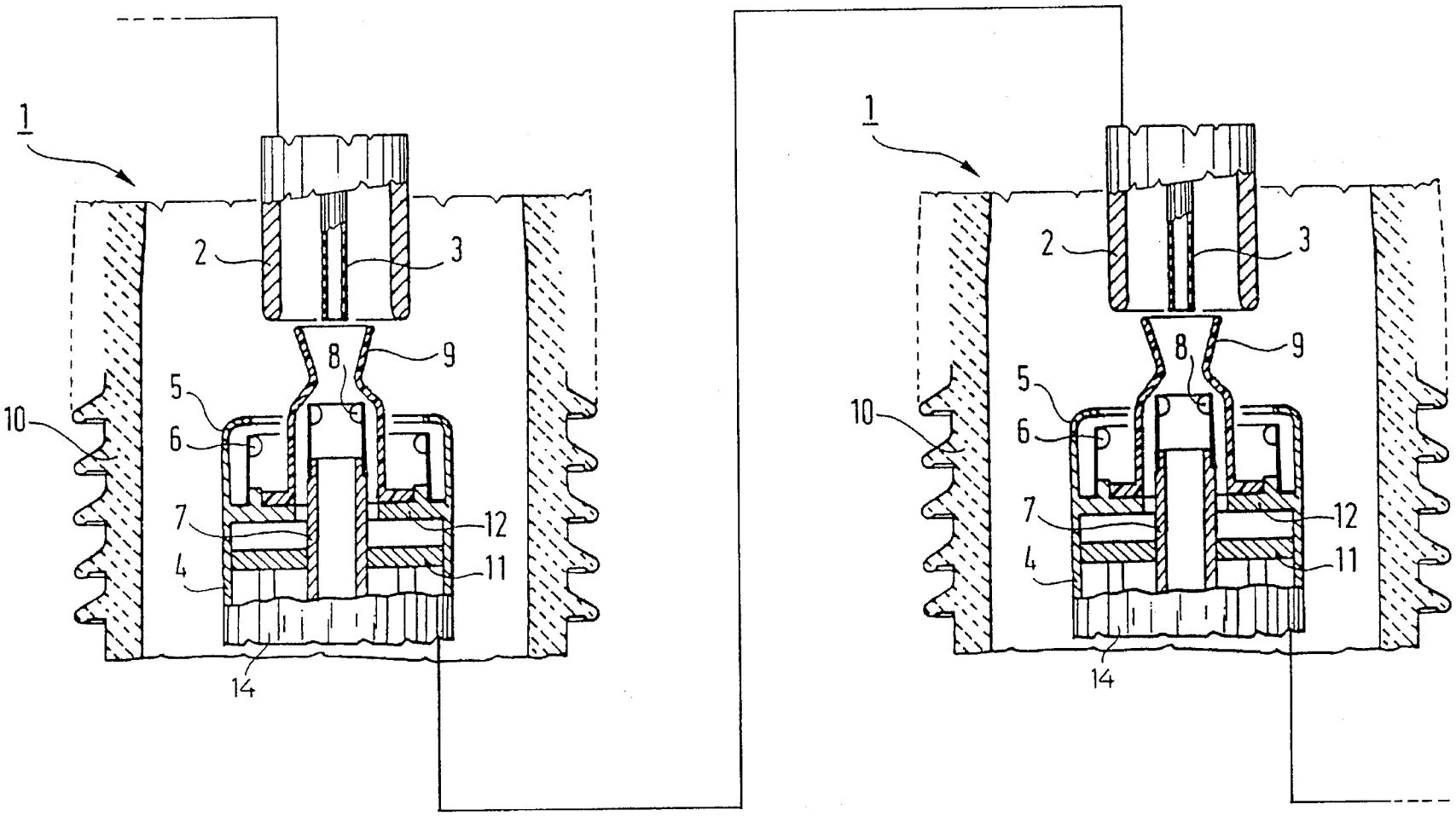
FIG. 6 shows two interrupting chambers connected in series.

The series-connected interrupting chambers, shown in FIG. 6, are fitted with means for opening them at an instant $t_1$ subsequent to the fault instant $t_0$, together with arc blasting means that operate between the instant $t_1$ and some later instant.

In conventional manner, the moving equipment is subjected to a normal opening displacement at a normal opening speed as defined by normal operating conditions, and this displacement comes to an end at instant $t_c$ shown in the figures. In accordance with the invention, the displacement of the moving equipment is modified starting from a threshold displacement d so as to terminate at an instant $t_2$ lying in the range $t_{zmax}-T$ and $t_{zmax}+T$, and advantageously $t_2$ is substantially equal to $t_{zmax}$.

In the first variant shown on the graph of FIG. 3, the threshold displacement d is preferably a fraction of its normal stroke, lying in the range 2D/3 and D, where D is the total normal stroke. At this threshold displacement d, the moving equipment is slowed down to a speed that is preferably constant so as to reach the total stroke D at the instant $t_2$.

In the second variant shown in FIG. 4, the threshold displacement d is equal to the total stroke D for normal opening. The total stroke D' is then increased and is greater than D.

Intermediate variants could also be envisaged, by modifying the speed when slowed down and/or the total stroke of the moving equipment.

Under such conditions, when the contacts open at instant $t_1$, an arc is established between the arcing contacts 3, 8, and in the event of a normal fault, it is extinguished by the blast gas in conventional manner. If the fault has a delayed zero crossing, with the blast continuing until instant $t_2$ under the most unfavorable conditions, it is still possible to extinguish the arc.

Tests and simulations have shown that in practice the time $t_2$ is preferably substantially equal to 110 milliseconds.

In all of the possible variants, the displacement of the moving equipment can be modified in various ways.

Figure 5:
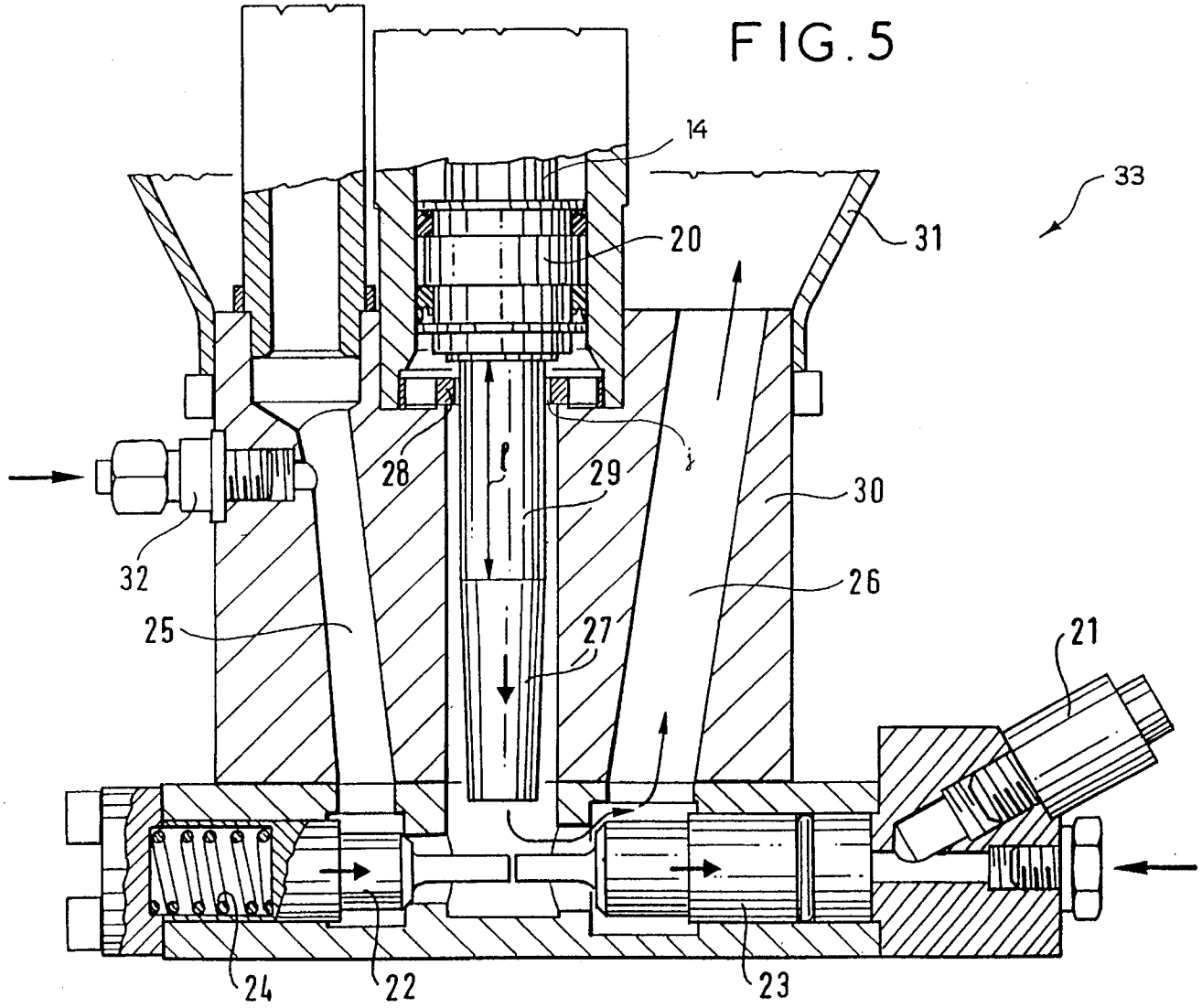
FIG. 5 is a longitudinal section view through the end of a hydraulic actuator including slowing-down means in accordance with the invention.

FIG. 5 shows the preferred embodiment of the means for slowing down the moving equipment when the moving equipment is displaced by a hydraulic actuator 33.

This figure shows the hydraulic actuator 33 in its tripped position, i.e. its position in which the contacts are open. The piston 20 of the actuator is at the end of its stroke. To reach this position, an "open" order is transmitted by a control coil that causes fluid under pressure to be evacuated via a non-return valve 21. A slide valve 22, released from the thrust of a slider 23, is thus displaced to the right (in the figure) under drive from its return spring 24. It therefore closes the passage for oil under pressure via the channel 25 that is fed from inlet 32, and the oil under pressure which normally keeps the piston 20 in its high position corresponding to the contacts being in the closed position is evacuated via the channel 26 that has been released by the slider 23.

In conventional manner, the piston 20 is fitted with a damping cone 27 which, during opening, co-operates with a ring 28 mounted in its housing with both longitudinal clearance and radial clearance. This disposition has the function, at the end of opening, of slowing down the piston 20 so that it follows the curved segment A in FIG. 3 or 4. The clearance of the ring 28 serves firstly to allow it to center itself automatically on the cone 27 and secondly to allow oil to pass between itself and the cone 27.

The slowing-down means of the invention are constituted by a length of cylinder 29 disposed between the piston 20 and the cone 27, and preferably integral with the cone 27. The cylinder 29 is of length l. The ring 28 is adjusted so as to obtain a certain radial clearance j between itself and the cylindrical portion 29.

Thus, during opening, the displacement of the contacts is initially slowed down in conventional manner by the cone 27 so as to follow curved segment A, after which it is slowed down at constant speed determined by the chosen clearance j and during a period of time $t_2-t_c$ determined by the selected length l of cylinder so as to follow the straight segment B shown in FIG. 3 or 4.

Implementing the invention therefore requires minimal adaptation of an existing circuit breaker.

The adaption required is particularly small when implementing the invention in application of the curve shown in FIG. 3. All that is then required is to install the damping cone 27 fitted with the cylindrical portion 29 on an existing piston 20, in which case the casing 30 needs to be lengthened.

When implementing the curve of FIG. 4, the stroke of the piston 20 also needs to be lengthened, which means that its rod and the chamber 31 must be lengthened as well.

A plurality of interrupting chambers may be used, depending on the characteristics of the network. In practice, at least four chambers may be provided. By way of example, four chambers are provided for a line at a tension of 800 kV.

There is thus no need for any intelligent apparatus for detecting the different phases of the fault current, and the interrupting chambers operate normally in two cycles from opening.

We claim:

1. A high tension circuit breaker for interrupting alternating fault currents having a pseudo-period T, a fault instant at time $t_0$ and a delayed zero crossing occurring after a maximum time lapse $t_{zmax}-t_0$ after $t_0$, said time lapse $t_{zmax}-t_0$ being determined by testing or simulation, said high tension circuit breaker comprising:

a plurality of interrupting chambers in series, each of said interrupting chambers having means for opening at an instant $t_1$, where $t_1$ is subsequent to $t_0$, each said interrupting chamber comprising a fixed main contact, a fixed arcing contact, moving equipment disposed adjacent to said fixed main contact and said fixed arcing contact and including a moving main contact, a moving arcing contact and arc blasting means disposed within said moving equipment for providing a blast to said contacts and designed to operate between instant $t_1$ and instant $t_c$, where $t_c$ is earlier than $t_{zmax}-T$; and means for driving said moving equipment including arc blast flow rate reducing means for extending arc blasting to an instant $t_2$, where $t_{zmax}-T \leqq t_2 \leqq t_{zmax}+T$.

2. A circuit breaker according to claim 1, wherein the instant $t_2$ is substantially equal to $t_{zmax}$.

3. A circuit breaker according to claim 1, wherein the time $t_2-t_0$ is substantially equal to seven pseudo-periods, 7T.

4. A circuit breaker according to claim 1, wherein said arc blasting means comprises a blast piston co-operating with said moving equipment by displacement relative to said moving equipment, wherein said moving equipment is subjected to normal opening displacement at a normal opening speed defined by normal operating conditions; and wherein the blast flow rate reducing means are means for slowing down the moving equipment beyond a threshold displacement d.

5. A circuit breaker according to claim 4, wherein the threshold displacement d lies in the range from 2D/3 to D, where D is the total normal stroke of the moving equipment.

6. A circuit breaker according to claim 4, wherein the moving equipment moves at constant speed when said means for slowing down is activated.

7. A circuit breaker according to claim 6, wherein said means for driving said moving equipment comprises a hydraulic actuator including a hydraulic actuator piston connected to a damping cone disposed in cooperation with a ring, wherein the slowing-down means are constituted by a length of cylinder portion disposed between the piston and the cone, the ring having a radial clearance from the length of cylinder.

* * * * *